United States Patent [19]

Pospisil et al.

[11] 4,060,882

[45] Dec. 6, 1977

[54] CYLINDERS AND ROLLERS FOR PRINTING MACHINES

[75] Inventors: Frantisek Pospisil, Brno; Vaclav Sedlak, Jedovnice, both of Czechoslovakia

[73] Assignee: Adamovske strojirny, narodni podnik, Adamov, Czechoslovakia

[21] Appl. No.: 652,778

[22] Filed: Jan. 27, 1976

[30] Foreign Application Priority Data

| | | |
|---|---|---|
| Jan. 27, 1975 | Czechoslovakia | 515/75 |
| Jan. 27, 1975 | Czechoslovakia | 512/75 |
| Jan. 27, 1975 | Czechoslovakia | 513/75 |

[51] Int. Cl.[2] ..... B21B 31/08

[52] U.S. Cl. ..... 29/132

[58] Field of Search ..... 29/132, 130, 129.5

[56] References Cited

U.S. PATENT DOCUMENTS

| | | | |
|---|---|---|---|
| 2,151,048 | 3/1939 | Rowe | 29/132 X |
| 2,695,248 | 11/1954 | Ornitz et al. | 29/132 X |
| 2,793,571 | 5/1957 | Way et al. | 29/132 X |
| 2,984,473 | 5/1961 | Ornitz et al. | 29/132 X |
| 3,080,134 | 3/1963 | England et al. | 29/132 X |
| 3,412,479 | 11/1968 | Markovic | 29/121.8 X |
| 3,942,230 | 3/1976 | Nalband | 29/132 |

*Primary Examiner*—Alfred R. Guest

[57] ABSTRACT

Cylinder and rollers for printing machines such as offset cylinders, impression cylinders, form cylinders and dampening rollers. The surface of the cylinder or roller consists of a layer inseparable from the cylinder proper. This layer has a thickness of 0.05 to 0.6 mm and consists of an oxide selected from the group of $Al_2O_3$, $TiO_2$, $Cr_2O_3$, $ZrO_3$ and Mgo and a combination of these oxides.

This layer may also consist of a metal alloy selected from the group of nickel-chromium and nickel-chromium-boron-silicon.

3 Claims, 2 Drawing Figures

CYLINDERS AND ROLLERS FOR PRINTING MACHINES

BACKGROUND OF THE INVENTION

This invention relates to printing cylinders and rollers for printing machines, particularly to offset printing cylinders, impression cylinders, form cylinders and dampening rollers, the surface of which has to be highly corrosion-resistant and also resistant to the influence of chemicals which are used for printing.

The surface of the above-named cylinders and rollers comes into contact with water, printing colors and different chemicals which are used for printing on printing machines. These substances cause a damaging corrosion on the surface of the printing cylinders. In addition to highly corrosion-resistant printing cylinders on printing machines, dampening rollers as well must have a sufficiently water-adhesive surface to insure a proper transfer of dampening liquid on the surface of the printing plate. The surface of said cylinders and rollers is generally finished by grinding to assure a smooth finish for the cylinder surface. An accurate coaxial positioning of the cylinder axis relative to the cylinder surface and a good surface quality are essential for good printing quality.

One of the known cylinders for printing machines is produced from a casting of high quality metal alloy, whereby the surface of the cylinder is accurately ground. A disadvantage of this type of cylinder is that it is very expensive to produce because quality alloys are very expensive. A further disadvantage resides in that it is difficult to obtain a metal alloy with optimum casting properties, particularly since very complex shapes have to be cast as, for example, the ribbed cavities of a printing cylinder.

There are also known printing cylinders for printing machines made from cast metal, the surface of which has to first be ground and then provided with a chromium layer which is about 10 to 15 millimicrons thick. The advantage of such a thin layer of chromium is that the surface of the cylinder does not require any further operation or additional working.

A disadvantage with such a cylinder provided with a layer of chromium is that on the edge portions of the cylinder there form projections of accumulated chromium which result in an inaccurate geometry of the cylinder or roller. Another disadvantage resides in the physical properties of such a thin layer; for example, such a thin layer provides reduced corrosion resistance.

There are known other cylinders of printing machines onto which a relatively thick layer of chromium is applied after surface grinding of the cylinder. However, such cylinders having such a thick layer of chromium must subsequently be ground to obtain a suitable surface. Such a grinding operation increases the production costs thereof considerably. The application of such a thick layer of chromium also requires substantially larger capacity chrome bath vanes.

Rollers for printing machines, for example, dampening rollers or distribution rollers, are made from a tube into which pivots are pressed from the sides, or are turned from solid bar material. Such rollers must be highly corrosion-resistant in order to function properly and to have the ability to transfer dampening liquid. Such rollers are, therefore, generally made from anti-corrosive alloy steel or the surface of such rollers are chromium-plated. One disadvantage of such rollers made from anti-corrosive steel is their high cost. On the other hand, chromium-plated cylinders and rollers are not sufficiently corrosion-resistant.

In addition to the aforementioned corrosion-resistant property, the surface of impression cylinders for multicolor printing machines, or for printing machines for printing on one side of a sheet of paper and, after adjustment, printing on both sides of the sheet, have an additional requirement principally that the surface of this impression cylinder must not smear the as yet undried ink on the surface of the printed picture on the sheet of paper which is transferred to the impression cylinder of the second printing unit, as well as accumulate ink on the surface of this impression cylinder. One of the known types of impression cylinders uses for this purpose a spanned net anti-corrosive material arranged on the surface of the impression cylinder which divides the surface of the cylinder into a number of equally spaced points. The contact surface of the cylinder is considerably reduced by means of this spanned net. The transferred paper sheet is contacted by this net and thereby the danger of smearing of the print on the sheet is reduced. This type of impression cylinder has the disadvantage of requiring a laborious cleaning of the net because as the net is used for a time, it becomes contaminated with ink. The ink also accumulates under the net and thereby increases the dimension of the cylinder which results in smudging on the area of the printed sheet.

There is also known an impression cylinder wherein the aforementioned net is replaced by a ragged metal foil which also is spanned on the surface of the cylinder. This foil usually is made from aluminum or a chromium-plated aluminum foil. An advantage of the foil in comparison with the spanned net resides in that the ink has no possibility of accumulating under the foil and additionally the cleaning of this foil is easier to accomplish than that of a metal net.

The disadvantage of the use of a ragged foil resides in that the foil becomes worn or damaged in a relatively short period of time, particularly along the edges of the cylinder over which the foil is spanned. The exchanging of the foil is difficult and time-consuming as well. A further disadvantage resides in the necessity of small tolerances for the thickness of the foil because the latter has an influence on the dimension and accurate geometry of the cylinder surface.

There is also known a cylinder, the surface of which is provided with a layer of chromium and has a special surface roughness. The disadvantage of this type of cylinder resides in that the layer of chromium is very thin and is only about 7 to 12 millimicrons thick. A thicker layer of chromium results in an inaccurate surface geometry for the cylinder due to accumulations of chromium along the edges of the cylinder. This accumulation is generally larger than is permissible for an acceptable accuracy. An additional working of the cylinder surface is not possible because the already existing surface roughness would then be removed. This roughness of the operative surface of the cylinder is essential for proper functioning of the cylinder. A thin layer of chromium is generally porous and this porosity generally reduces the corrosion-resistance properties considerably.

SUMMARY OF THE INVENTION

The aforementioned disadvantages are avoided by a cylinder in accordance with the present invention. The metal cylinder of this invention is provided with a non-separable layer having a thickness in the range of 0.05 to 0.6 mm. This layer consists of one of the oxides of the following groups of oxides and of mixtures of the following oxides formed by a combination thereof: $Al_2O_3$, $TiO_2$, $Cr_2O_3$, $ZrO_3$ and MgO. The non-separable surface layer on the metal cylinder can also be made of one of the following metal alloys: nickel-chromium alloy with a proportion of 80% by weight of nickel and 20% by weight of chromium, nickel-chromium-boron-silicon in a proportion of about 4 to 20% by weight of chromium, 1 to 6% by weight of boron, 1 to 6% by weight of silicon and the remainder nickel, and anti-corrosive steel. The non-separable surface layer on the cylinder can also be made from zirconium silicate ($ZrSiO_4$), molybdenum silicon ($MoSi_2$), or from a mixture consisting of a combination of the aforementioned compounds. Between the surface layer and the surface proper of the metal cylinder there is provided at least one intermediate layer consisting of one of the nickel-chromium alloys having a proportion of about 80% by weight of nickel and about 20% by weight of chromium, and a further nickel-aluminum alloy having a proportion of about 70% by weight of nickel and 30% by weight of aluminum. The surface roughness is in the range of Ra = 7 to 25 microns.

The surfaces of cylinders and rollers of the present invention having the afore-described layers are highly corrosion-resistant and also are resistant to the aggressive influences of chemicals which are used in the printing art and, by virtue of these properties, the life time of the cylinders is considerably increased when compared with those of the prior art. A further advantage of the described invention resides in that the surface layer formed by metal silicons is not electrically conductive and therefore the potential effects of contact corrosion are virtually eliminated. Such contact corrosion generally occurs between the surface of the form cylinder and the printing plate. The dampening rollers of the invention have excellent hydrophylic properties on their surface layers, by means of which a proper transfer of the dampening liquid is assured. A further advantage of the printing cylinders in accordance with the present invention resides in that the surface layer duplicates exactly the surface proper of the cylinder so that the surface geometry of the cylinder is unchanged and therefore the necessity of an additional grinding operation to conform the cylinder surface is eliminated.

Another advantage of a roughened surface layer on a printing cylinder, particularly an impression cylinder used on multi-color printing machines and machines for printing on both sides of the sheet of paper, according to the instant invention resides in that the danger of smearing of as yet undried ink on the print on the paper is considerably reduced.

DESCRIPTION OF THE DRAWING

The invention will be more fully understood upon consideration of the illustrative preferred embodiments shown in the accompanying drawing. In the drawing.

DESCRIPTION OF THE PREFERRED EMBODIMENTS

Figure 1:
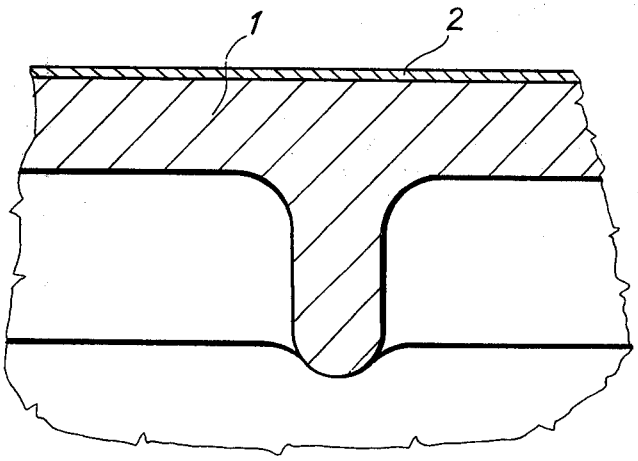
FIG. 1 is a longitudinal partial section of a printing cylinder in accordance with the invention provided with a surface layer.
Figure 2:
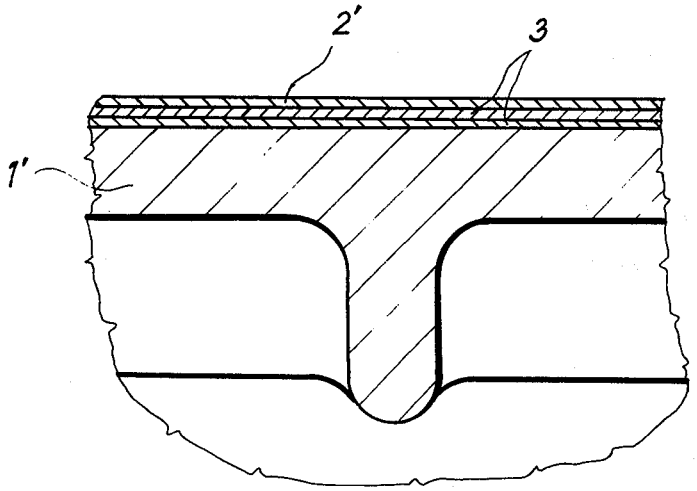
FIG. 2 is an alternate embodiment of the cylinder in longitudinal partial section having an outer layer and an intermediate layer.

The several embodiments of the cylinders and rollers of this invention are elucidated in the following examples:

EXAMPLE 1

A form cylinder 1 made from cast iron, which is surface-ground, is provided with a surface layer 2 consisting of about 70% by weight of aluminum oxide ($Al_2O_3$) and 30% by weight of titanium oxide ($TiO_2$), the surface layer thickness being 0.2 mm.

EXAMPLE 2

A form cylinder 1' made from cast ron, after grinding of the surface, is provided with an intermediate layer 3 consisting of an alloy of nickel-aluminum with a proportion of about 70% by weight of nickel and 30% by weight of aluminum, having a thickness of 0.05 mm, and a surface layer 2' consisting of about 87% by weight of aluminum oxide ($Al_2O_3$) and 13% by weight of titanium oxide ($TiO_2$) having a thickness of 0.2 mm.

EXAMPLE 3

An impression cylinder 1 for a perfecting printing machine, adapted for printing on both sides of a sheet of paper, made from cast iron, in which the surface of the impression cylinder is provided, after grinding, with a surface layer 2 consisting of stainless steel having chromium-nickel content and having a surface roughness of Ra = 14 microns.

EXAMPLE 4

An impression cylinder 1' for a perfecting printing machine, adapted for printing on both sides of a sheet of paper, made from cast iron, the surface of the impression cylinder is provided, after grinding, with an intermediate layer 3 consisting of a nickel-aluminum alloy with a proportion of about 70% by weight of nickel and 30% by weight of aluminum, having a thickness of 0.05 mm. The intermediate layer 3 forms the base for the surface layer 2' consisting of stainless steel having a chromium-nickel content and having a thickness of 0.15 mm and a surface roughness of Ra = 14 microns.

EXAMPLE 5

A messenger roller 1 for a dampening device made from normal steel having a low carbon content, the roller 1 being provided with a surface layer 2 consisting of zirconium silicon ($ZrSiO_4$) and having a thickness of 0.20 mm.

EXAMPLE 6

A messenger roller 1' of a dampening device made from normal steel having low carbon content, the roller 1' being provided with an intermediate layer 3 consisting of about 80% by weight of nickel and 20% by weight of chromium and having a thickness of 0.06 mm. The intermediate layer 3 forms a base for a surface layer 2' consisting of zirconium silicon ($ZrSiO_4$) and having a thickness of 0.15 mm.

Although the invention is illustrated and described with reference to a preferred number of embodiments thereof, it is to be expressly understood that it is in no way limited to the disclosure of such a plurality of preferred embodiments, but is capable of numerous modifications within the scope of the appended claims.

What is claimed is:

1. A cylinder roller for printing machines, comprising a cylinder body made of a corrodible ferrous metal, and at least one inseparable non-corrodible cylindrical surface layer on the body of said cylinder or roller, said layer consisting in combination of at least two metal oxides selected from the group consisting of $Al_2O_3$, $TiO_2$, $CrO_3$, and MgO, said inseparable layer having a thickness of 0.05 to 0.6 mm.

2. The improved cylinder or roller for printing machines as set forth in claim 1, and at least one intermediate layer between said inseparable cylindrical surface layer and the body of said cylinder or roller, said intermediate layer consisting of a metal alloy selected from the group of nickel-chromium of about 80% by weight of nickel and about 20% by weight of chromium, and nickel-aluminum of about 70% by weight of nickel and about 30% by weight of aluminum.

3. The improved cylinder or roller for printing machines as set forth in claim 1, wherein said inseparable cylindrical surface layer has a surface roughness Ra of 7 to 25 microns.

* * * * *